US008205570B1

(12) United States Patent
Tureaud et al.

(10) Patent No.: US 8,205,570 B1
(45) Date of Patent: Jun. 26, 2012

(54) AUTONOMOUS UNMANNED UNDERWATER VEHICLE WITH BUOYANCY ENGINE

(75) Inventors: Thomas F. Tureaud, Fairfax, VA (US); Douglas E. Humphreys, Great Falls, VA (US)

(73) Assignee: Vehicle Control Technologies, Inc., Reston, VA (US)

( * ) Notice: Subject to any disclaimer, the term of this patent is extended or adjusted under 35 U.S.C. 154(b) by 258 days.

(21) Appl. No.: 12/697,814

(22) Filed: Feb. 1, 2010

(51) Int. Cl.
*B63G 8/14* (2006.01)

(52) U.S. Cl. ..... 114/330; 114/337

(58) Field of Classification Search ..... 440/1; 114/312, 114/330, 337, 244
See application file for complete search history.

(56) References Cited

U.S. PATENT DOCUMENTS

| | | | |
|---|---|---|---|
| 3,105,453 | A | 10/1963 | Hayes |
| 3,466,798 | A | 9/1969 | Speers et al. |
| 3,647,253 | A | 3/1972 | Hettinger et al. |
| 3,987,745 | A | 10/1976 | Chaverebiere de Sal et al. |
| 4,010,619 | A | 3/1977 | Hightower et al. |
| 4,204,806 | A | 5/1980 | Blanchard |
| 5,120,099 | A | 6/1992 | Fletcher |
| 5,158,034 | A | 10/1992 | Hsu |
| 5,183,384 | A | 2/1993 | Trumbly |
| 5,396,860 | A | 3/1995 | Cheng |
| 5,568,783 | A | 10/1996 | Ditchfield |
| 5,686,694 | A | 11/1997 | Hillenbrand et al. |
| 5,708,230 | A | 1/1998 | Woodall, Jr. et al. |
| 5,713,293 | A | 2/1998 | Shiffler et al. |
| 5,786,545 | A | 7/1998 | Hillenbrand |
| 6,213,021 | B1 | 4/2001 | Pickett |
| 6,359,834 | B1 | 3/2002 | English |
| 6,390,012 | B1 | 5/2002 | Watt et al. |
| 6,600,695 | B1 | 7/2003 | Nugent et al. |
| 6,738,314 | B1 | 5/2004 | Teeter et al. |
| 6,766,745 | B1 | 7/2004 | Kuklinski et al. |
| 7,000,560 | B2 | 2/2006 | Wingett et al. |
| 7,051,664 | B2 | 5/2006 | Robichaud et al. |
| 7,530,864 | B2 * | 5/2009 | Kaji ..... 440/1 |
| 2001/0025594 | A1 | 10/2001 | Daniels |
| 2002/0152945 | A1 | 10/2002 | Geriene et al. |
| 2008/0024356 | A1 | 1/2008 | Schober |
| 2009/0241826 | A1 * | 10/2009 | Vosburgh et al. ..... 114/330 |
| 2009/0259400 | A1 | 10/2009 | Coats et al. |
| 2009/0259401 | A1 | 10/2009 | Edwards et al. |
| 2009/0292468 | A1 | 11/2009 | Wu et al. |

OTHER PUBLICATIONS

Vehicle Control Technologies, Inc., "STTR Proposal No. N08A-016-0269—Expendable Glider for Oceanographic Research", Mar. 18, 2008, pp. 3-25.

* cited by examiner

*Primary Examiner* — Stephen Avila
(74) *Attorney, Agent, or Firm* — Womble Carlyle Sandridge & Rice, LLP

(57) ABSTRACT

An autonomous unmanned underwater vehicle ("AUV") includes a body, a controller, a buoyancy engine, a rotary propulsion system and pitch control surface(s). The buoyancy engine is for alternately ingesting and expelling ambient water to change the mass of the AUV and thereby cause the AUV to alternately descend and ascend in the water. The pitch control surface(s) are for causing the AUV to move forward while alternately descending and ascending in the water. The rotary propulsion system includes a motor for rotating a propeller in the water to provide thrust. The controller is operative for responsively, automatically switching between at least the glider and rotary propulsion modes. In the glider mode, the buoyancy engine and the pitch control surface(s) are cooperative for causing the AUV to move forward while alternately descending and ascending. In the rotary propulsion mode, the rotary propulsion system is operative for causing the AUV to move forward.

20 Claims, 10 Drawing Sheets

AUTONOMOUS UNMANNED UNDERWATER VEHICLE WITH BUOYANCY ENGINE

TECHNICAL FIELD

The present disclosure relates to unmanned underwater vehicles and, more particularly, to an autonomous unmanned underwater vehicle that may be powered by a buoyancy engine.

BACKGROUND

An underwater glider is a type of autonomous unmanned underwater vehicle ("AUV") that is powered by a buoyancy engine. The buoyancy engine is carried by the glider and typically includes a motor that is operative for changing the effective volume of a chamber, so that the chamber alternately ingests and expels ambient water to change the mass of the glider, so that the glider alternately ascends and descends. Conventional gliders typically include hydrodynamic wings for causing the AUV to move forward while alternately descending and ascending in the water. A conventional underwater glider with a conventional buoyancy engine may be inadequate in some situations.

BRIEF SUMMARY

In accordance with one aspect of this disclosure, an autonomous unmanned underwater vehicle ("AUV") includes a controller, a buoyancy engine, a rotary propulsion system and at least one pitch control surface. The buoyancy engine is for alternately ingesting and expelling ambient water to change the mass of the AUV and thereby cause the AUV to alternately descend and ascend in the water. The pitch control surface is for causing the AUV to move forward while alternately descending and ascending in the water. The rotary propulsion system includes a motor for rotating a rotary agitator (e.g., a propeller or an impeller) in the water to provide thrust. The controller is operative for responsively, automatically switching between at least glider and rotary propulsion modes. In the glider mode, the buoyancy engine and the pitch control surface cooperate to cause the AUV to move forward while alternately descending and ascending. In the rotary propulsion mode, the rotary propulsion system causes the AUV to move forward. The automatic switching between the modes may enhance performance of the AUV.

Other aspects and advantages will become apparent from the following.

BRIEF DESCRIPTION OF THE DRAWINGS

Having described some aspects of this disclosure in general terms, reference will now be made to the accompanying drawings, which are not necessarily drawn to scale, and wherein.

DETAILED DESCRIPTION

In the following, several exemplary embodiments of this disclosure are discussed in greater detail with reference to the drawings, in which like numerals refer to like parts throughout the several views. The exemplary embodiments are generally discussed in series, starting with a first embodiment, then a second embodiment, and then a third embodiment.

Initially, an autonomous unmanned underwater vehicle ("AUV") 20 of the first embodiment is described. A general discussion of the components of the AUV 20 is followed by a general discussion of how the AUV 20 may operate, and thereafter there is a more specific discussion of the components of the AUV 20, followed by a more specific discussion of operation of the AUV 20.

Figure 1:
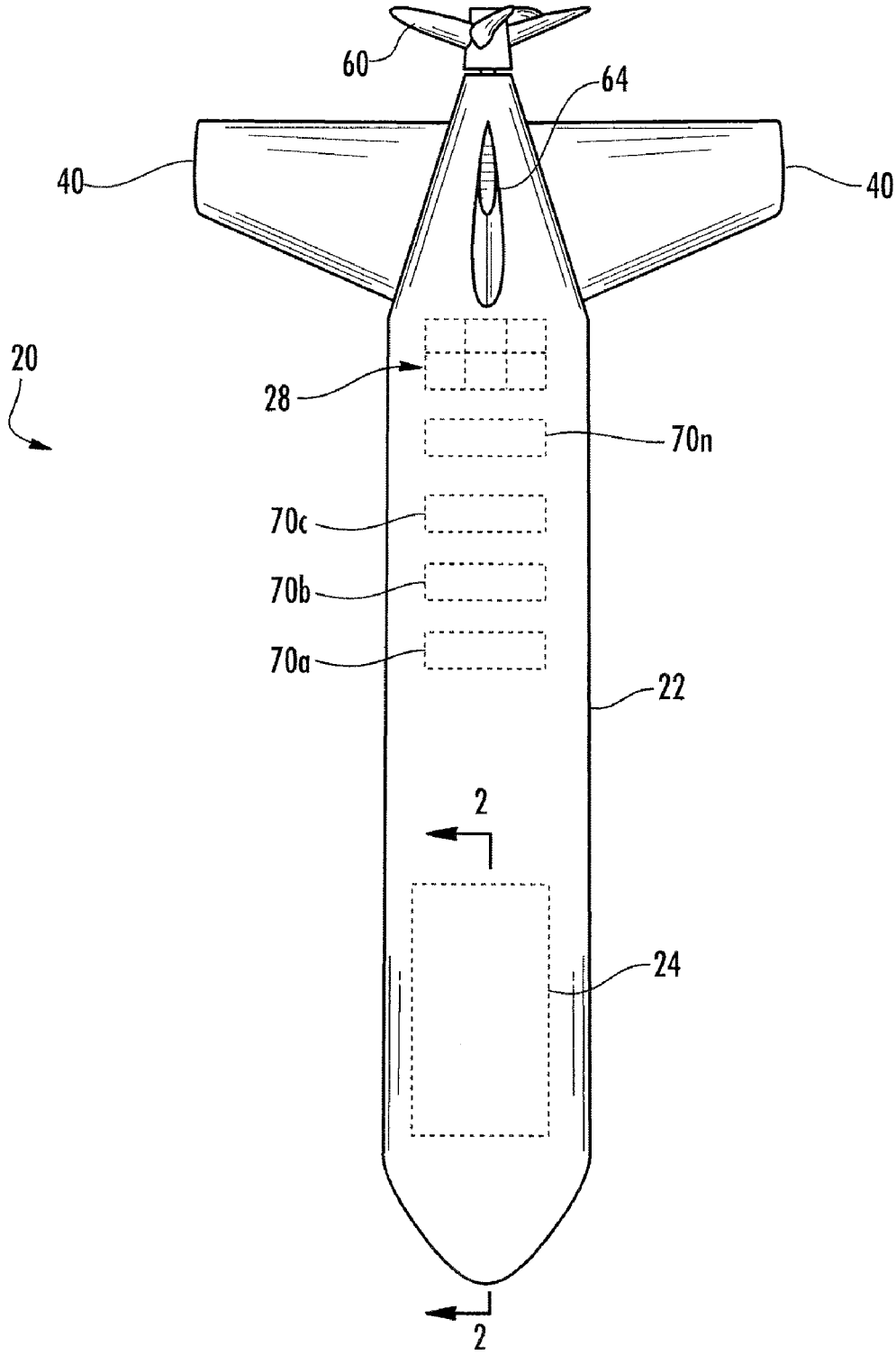
FIG. 1 is a schematic top plan view of an autonomous unmanned underwater vehicle ("AUV") in accordance with a first embodiment of this disclosure.

FIG. 1 is a schematic top plan view of the AUV 20. In FIG. 1, some of the AUV's internal components, which are typically hidden from view, are shown in dashed lines. As shown in FIG. 1, the AUV has a body including a cylindrical hull 22 with a rounded front end and a tapered rear end. Any other suitably shaped body/hull may be used.

Figure 2:
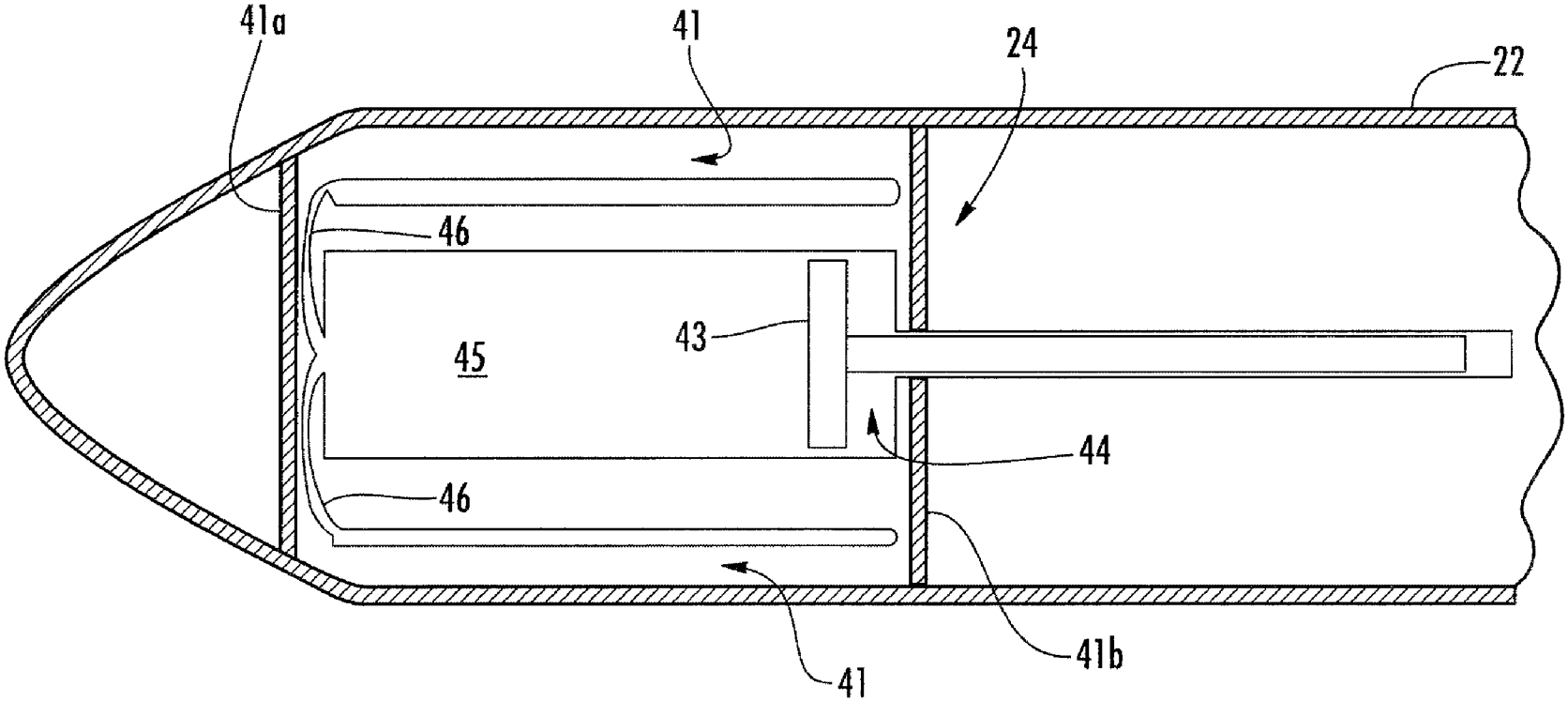
FIG. 2 (PRIOR ART)
FIGS. 2 and 3 are schematic cross-sectional views of a forward portion (e.g., buoyancy engine) of the AUV of FIG. 1, with the cross-sections taken substantially along line 2-2 of FIG. 1.
Figure 3:
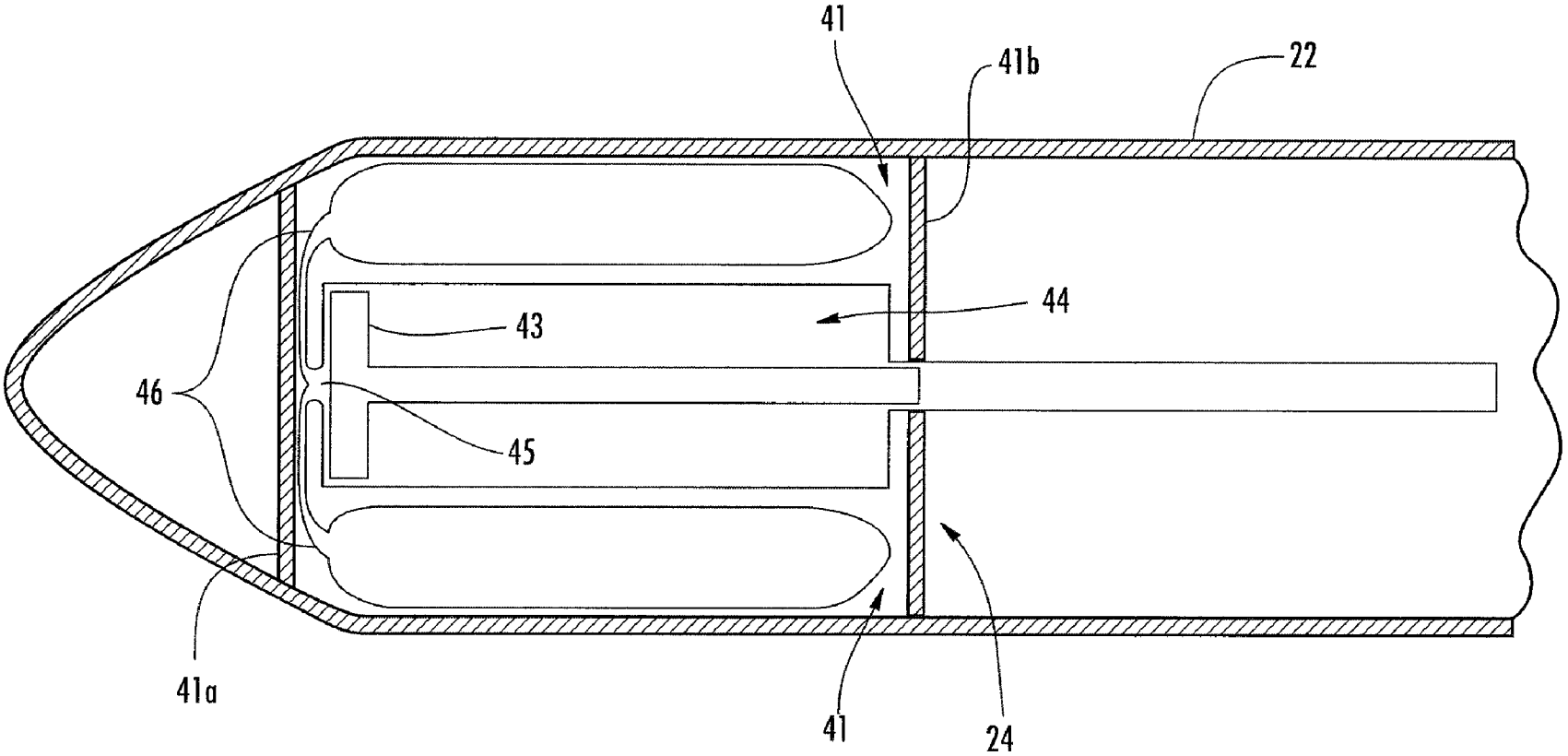
FIG. 3 (PRIOR ART)

FIGS. 2 and 3 are schematic cross-sectional views of a forward portion of the AUV 20, with the cross-sections taken substantially along line 2-2 of FIG. 1. FIGS. 2 and 3 schematically show portions of one of the internal component of the AUV 20, namely a portion of a buoyancy engine 24 (e.g., ballast system) that is for changing the net buoyancy of the AUV, and the changes in net buoyancy are used to propel the AUV. The buoyancy engine 24 of the first embodiment of this disclosure is conventional/is not novel per se. Generally described, the buoyancy engine 24 is in a configuration for causing the AUV 20 to descend in FIG. 2, and a configuration for causing the AUV 20 to ascend in FIG. 3. The buoyancy engine 24 provides negative net buoyancy for descending, and positive net buoyancy for ascending, as will be discussed in greater detail below with reference to FIG. 6.

Figure 13:
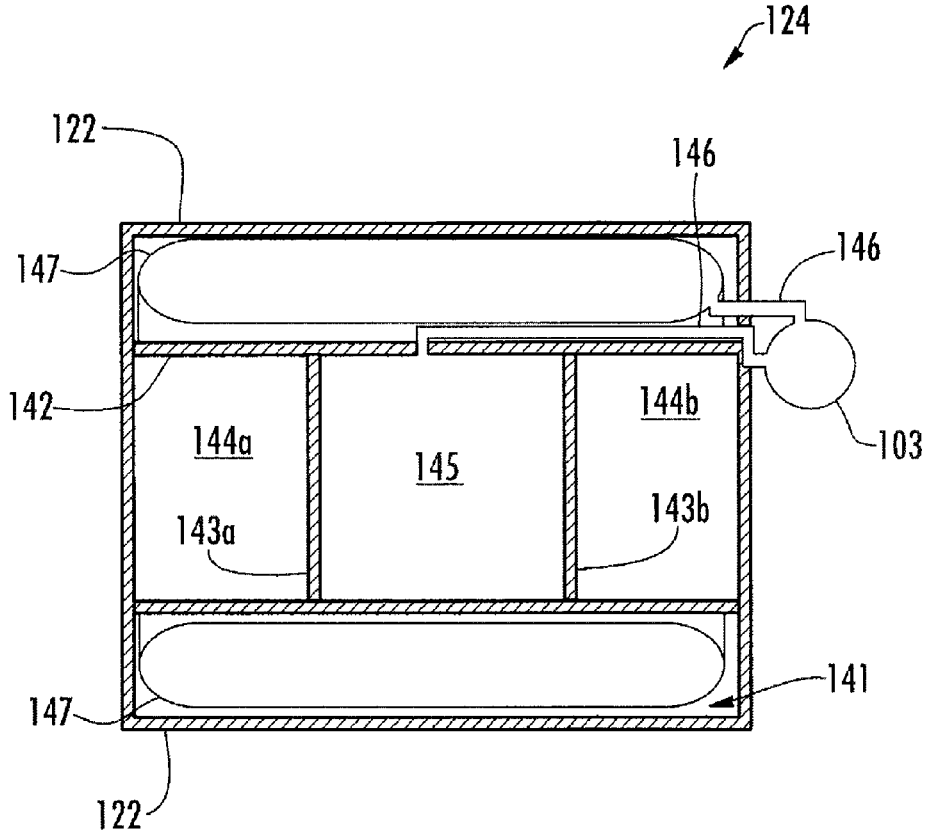
FIG. 13 is a schematic cross-sectional view of a middle portion of (e.g., a buoyancy engine of) the AUV of FIGS. 10-12, with the cross-section taken substantially along line 13-13 of FIG. 10.

The buoyancy engine 24 that is schematically, partially shown in FIGS. 2 and 3 is of a type that is typically located in, or proximate to, the nose (e.g., front end) of the AUV 20, and that causes a change in the center of gravity of the AUV while the buoyancy engine is operating. A variety of different buoyancy engines may be used at different locations within the AUV 20. For example, FIG. 13 illustrates another buoyancy engine that is discussed in greater detail below, in accordance with the second embodiment of this disclosure. For example and as discussed in greater detail below, it is optional for the buoyancy engine of the AUV 20 to cause a change in the center of gravity of the AUV.

Figure 4:
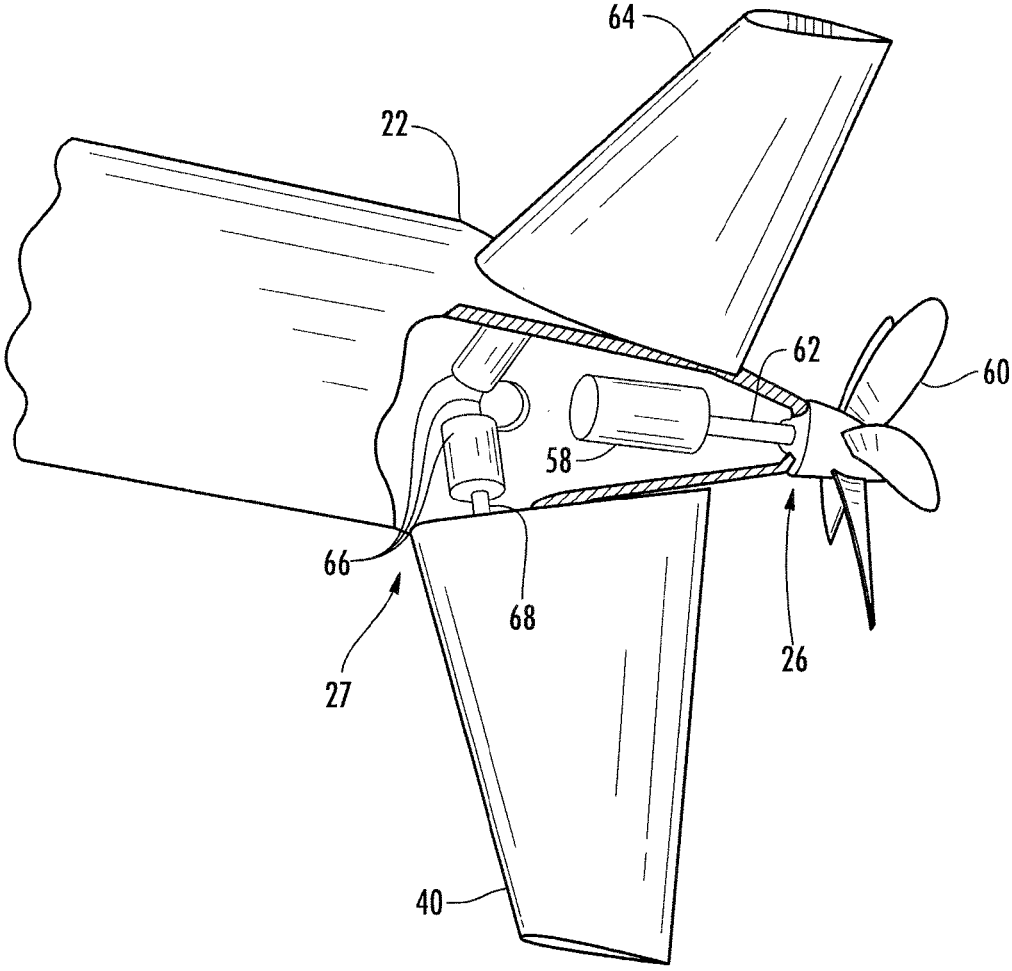
FIG. 4 is a schematic, perspective, partially cut-away view of a rear portion of the AUV of FIG. 1, and it shows a rotary propulsion system and steering system of the AUV.

FIG. 4 is a schematic, perspective, partially cut-away view of a rear portion of the AUV 20. FIG. 4 schematically shows additional internal components of the AUV 20, namely internal components of a rotary propulsion system 26 and a steering system 27 that has fins 40, 64 or other suitable control surfaces. In accordance with the first embodiment, the steering system 27 is operative (e.g., the side fins 40 of the steering system are operative), for example, for pitching the nose of the AUV 20 up and down in a manner that is cooperative with the changes in net buoyancy for propelling the AUV, as will be discussed in greater detail below.

Another of the internal components of the AUV 20 is a controller 28 (FIG. 1) that is operative for, typically among other things, automatically switching between the different propulsion systems of the AUV 20 in response to detecting one or more predetermined conditions. More specifically and for example, the controller 28 may automatically switch between usage of the buoyancy engine 24 (e.g., a glider mode of travel in which the AUV may travel forward while alternately descending and ascending) and the rotary propulsion system 26 (e.g., a rotary propulsion mode of travel in which the AUV may travel forward, optionally without descending and/or ascending). Whereas the AUV 20 may, in some situations, operate in only one mode of travel (e.g., either the glider mode or the rotary propulsion mode) while traveling to a destination, the AUV 20 may, in some situations, function in multiple different modes while traveling toward a destination. That is and in accordance with the first embodiment, the controller 28 is operative for automatically switching between different modes of travel so that the AUV 20 may operate in one, two, or any number of different modes on a given mission.

Figure 5:
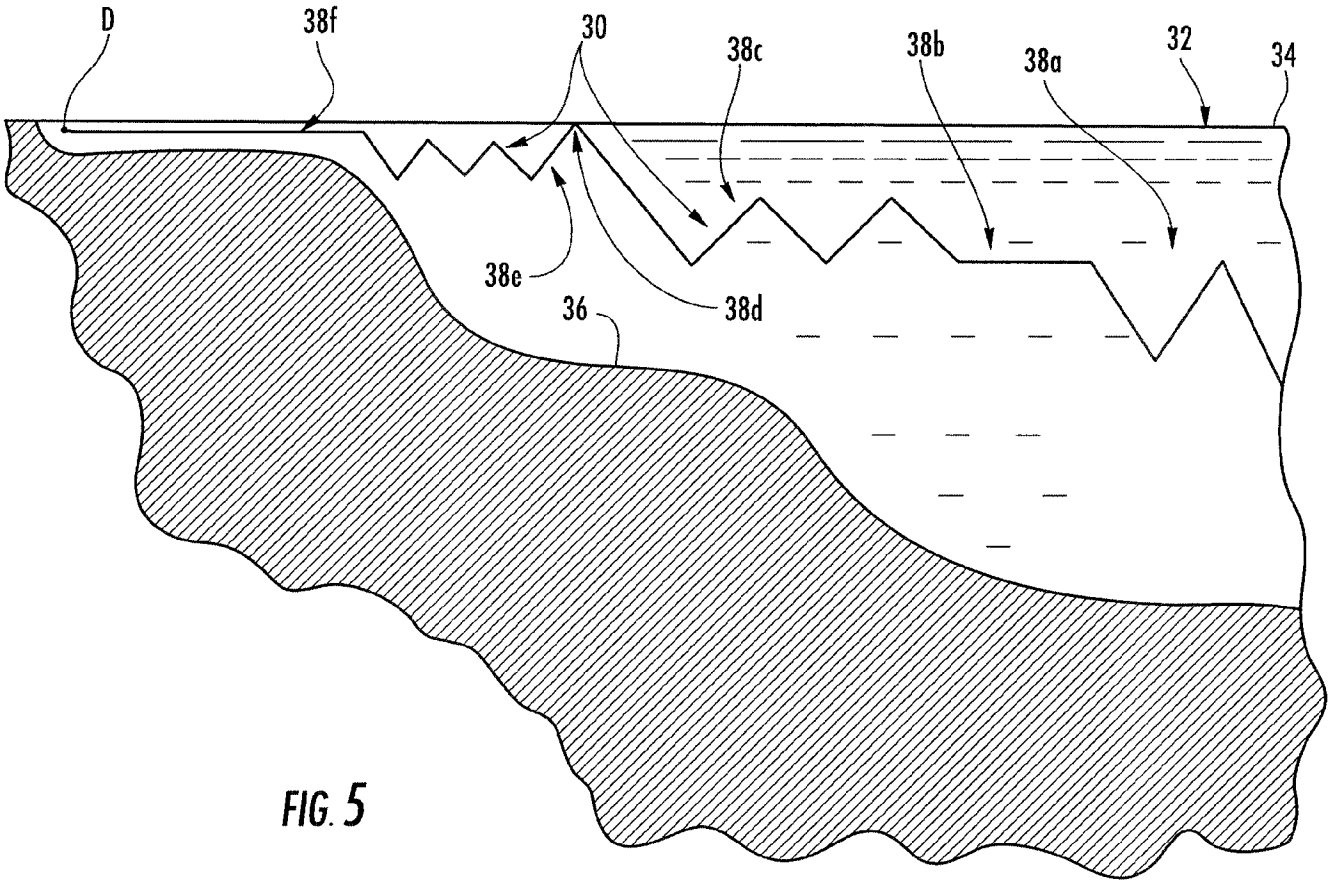
FIG. 5 is a schematic side view of a body of water and underlying ground, and it schematically illustrates an example of a path of travel of the AUV of FIG. 1 in the body of water, in accordance with the first embodiment.

An example of one theoretical/prophetic path 30 of travel of the AUV 20 (FIG. 1) in a body of water 32 is schematically shown in FIG. 5, although numerous other paths of travel of the AUV are within the scope of this disclosure. FIG. 5 is a schematic, vertical cross-sectional view illustrating that the body of water 32 is bounded between a top surface 34 and a bottom 36 of the body of water. The depth of the body of water 32 varies with the elevation of the bottom 36, so that the body of water includes a shallow portion and a deep portion, and portions between the shallowest and deepest portions.

As schematically shown in FIG. 5, the path 30 includes a destination D. In FIG. 5, the destination D is shown in the shallow portion of the body of water 32, although the destination may be in any other suitable location within the body of water. The destination D may be a location to which the AUV 20 autonomously travels (e.g., a location where a mission ends), or the destination D may be an intermediate location (e.g., the destination D may optionally also be a location from which the AUV 20 returns after travelling thereto). In one example of operating in the context of FIG. 5, the AUV may travel from right to left along the path 30 to the destination D. The AUV 20 may be a disposable item that is launched in any suitable manner and thereafter never be recovered (e.g., the payload contained by the AUV may be detonated at the destination D), or the AUV may be an item that is retrieved in any suitable manner, and then reused one or numerous times.

As mentioned above, the controller 28 (FIG. 1) is typically operative for automatically switching between different modes of travel of the AUV 20 in the body of water 32. For example and not limitation, FIG. 5 schematically illustrates that the AUV 20 may operate in a glider mode, a rotary propulsion mode and a surface mode. In this regard, the path 30 shown in FIG. 5 includes sections 38*a*-38*f* for schematically illustrating different modes of operation (e.g., modes of travel) of the AUV 20.

Sections 38*a*, 38*c* and 38*e* of the path 30 schematically illustrate the AUV 20 operating in the glider mode. In the glider mode, the buoyancy engine 24 and the steering system 27, namely the pitch control surfaces (e.g., see the side fins 40 in FIGS. 1 and 4), cooperate to cause the AUV 20 to move forward in the body of water 32 while the AUV is alternately descending and ascending.

Sections 38*b* and 38*f* of the path 30 schematically illustrate the AUV 20 operating in the rotary propulsion mode. In the rotary propulsion mode, the rotary propulsion system 26 operates, typically in cooperation with the steering system 27, for causing the AUV 20 to move forward, although the AUV may also move rearward in some embodiments.

Section 38*d* of the path 30 schematically illustrates the AUV 20 operating in a surface mode in which the AUV approaches and remains (e.g., remains stationary) at the surface of the body of water 32. In accordance with the first embodiment, the rotary propulsion system 26 may be inoperative (i.e., turned off) while the AUV 20 operates in the buoyancy and surface modes, and the buoyancy engine 24 may be inoperative (i.e., turned off) while the AUV operates in the rotary propulsion mode.

The modes of operation of the AUV 20 and the switching between the modes are discussed in greater detail below. Notwithstanding the foregoing or the following, the AUV 20 may, in some situations, operate only in one mode of operation (e.g., mode of travel) while traveling to a destination (e.g., the destination D).

In accordance with one example, the buoyancy engine 24 (FIGS. 2, 3 and 6) in and of itself may be conventional, the rotary propulsion system 26 (FIG. 4) in and of itself may be conventional, the steering system 27 (FIG. 4) in and of itself may be conventional, and the hardware of the controller 28 (FIG. 1) in and of itself may be conventional (e.g., the controller 28 may be a conventional computer). In contrast and for example, using the buoyancy engine 24 and the rotary propulsion system 26 in combination (e.g., automatically switching between using them), the controller's software or firmware modules (e.g., that are operative for signaling the switching), and other features of this disclosure may be inventive. The various features of this disclosure that are believed to be inventive may be in a variety of different combinations and subcombinations.

More specifically regarding the buoyancy engine 24 (FIGS. 2 and 3), it is for using some of the ambient water 32 (FIG. 5) as ballast, to change the mass of the AUV 20. That is, the buoyancy engine 24 alternately ingests and expels water 32 to cause the AUV to alternately descend and ascend in the water. The water 32 is ingested into, and expelled from, a ballast chamber 41. The ballast chamber 41 is typically contained within the hull 22 and is for being in fluid communication with the body of water 32 while the AUV 20 is in the body of water. In accordance with the first embodiment, the ballast chamber 41 has a fixed volume that extends around a cylinder 42 that is centrally located in the hull 22. The ballast chamber 41 extends between the interior surface of the hull 22 and the outer surface of the cylinder 42, and the ballast chamber 41 also extends between opposite ends 41*a*, 41*b* of the ballast chamber. The opposite ends 41*a*, 41*b* of the ballast chamber 41 may be in the form of water-tight bulkheads or any other suitable structures. While the AUV 20 is in the body of water 32, the ballast chamber 41 is in fluid communication with the body of water 32 by way of one or more passageways (not shown) that extend between the exterior of the hull 22 and the interior of the ballast chamber 41.

The inner chamber of the cylinder 42 contains a movable piston 43 that divides the inner chamber of the cylinder 42 into a gas chamber 44 (e.g., a fully closed chamber that contains air or any other suitable gas, or the like) and a liquid chamber 45 (e.g., a chamber that contains water, oil or any other suitable liquid that is not too compressible, or the like). The liquid chamber 45 is fully closed, except for being open to one or more passageways 46 (e.g., tube(s), pipe(s) or any other suitable means for fluid communication) that are open to the interior of one or more flexible bladders 47 within the ballast chamber 41. Generally described and as will be discussed in greater detail, the piston 43 is moved to change the volume of the liquid chamber 45, so that the size of the bladders 47 is responsively changed to cause the ballast chamber 41 to alternately ingest and expel ambient water 32 to change the mass of the AUV 20.

Generally described, the volume of the liquid chamber 45 is changed in response to operation of a motor, so that the ballast chamber 41 alternately ingests and expels ambient water 32 to change the mass of the AUV 20. That is, the ingestion and expulsion of water 32 is responsive to reciprocation of the piston 43. Any suitable mechanism may be used for causing the reciprocation of the piston 43, such as, but not limited to, a linear electric motor, a pneumatic system (e.g., including a pneumatic actuator) or a hydraulic system (e.g., including a hydraulic actuator (e.g., an electric motor-driven pump)).

Figure 6:
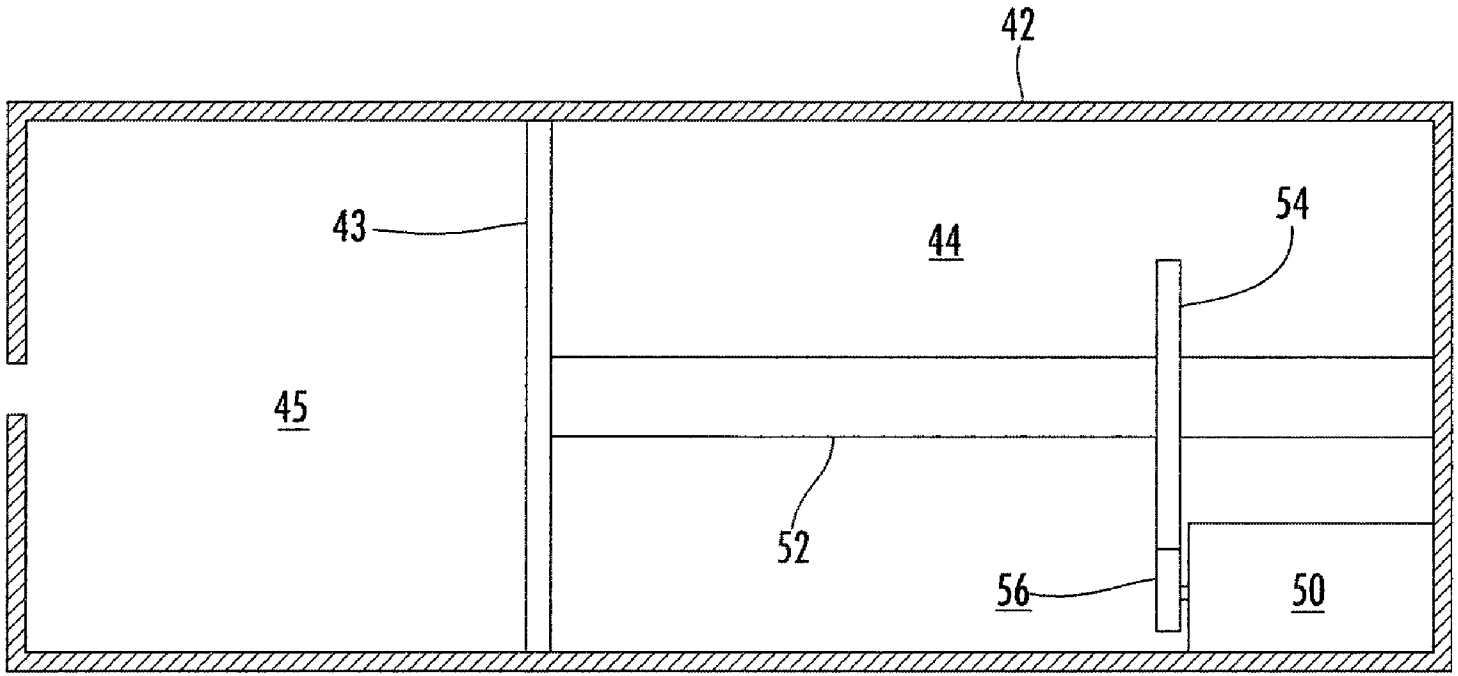
FIG. 6 (PRIOR ART)
FIG. 6 is a schematic, isolated, partially cutaway side view of a cylinder of the buoyancy engine and components within the cylinder, in accordance with the first embodiment.

In accordance with the first embodiment and as best understood with reference to FIG. 6, the piston 43 is reciprocated by mechanical system to change the volume of the gas chamber 44 and liquid chamber 45. In accordance with the first embodiment, the mechanical system for moving the piston includes a reversible, direct-current electric motor 50 and any suitable gear train for causing the piston 43 to reciprocate. For example, the gear train may include an externally threaded, rotatably mounted spindle/worm 52 that is rotatably connected (e.g., either directly or indirectly) to the piston 43 for reciprocating therewith, a worm gear 54 that extends around the worm 52 and has internal threads that are meshed with the worm, and a drive gear 56 that is mounted to the drive shaft of the motor 50 and meshed with external threads of the worm gear 54.

The motor 50 is operated to cause the piston 43 to move forward so that water 32 is expelled from the ballast chamber 41 and the AUV 20 ascends. The AUV 20 may continue to ascend after the piston 43 is in its forward position. The motor 50 is operated to cause the piston 43 to move to its rearward position so that water 32 is ingested into the ballast chamber 41 and the AUV 20 descends. The AUV 20 may continue to descend after the pistons 43 is in its rearward position.

More specifically regarding the rotary propulsion system 26 (FIG. 4) of the first embodiment, it includes a motor 58 for rotating a rotary agitator 60 (e.g., an impeller or a propeller) in the water 32 to provide thrust, and thereby cause the AUV 20 to move forward in the water. In accordance with the first embodiment, the motor 58 is a direct-current electric motor, which may include or otherwise be linked to gears (not shown) for stepping up or stepping down the motor's output, and the rotary agitator 60 is an external propeller. The propeller 60 is mounted on/for rotating with an output drive shaft 62 that is rotated by the motor 58. In accordance with the first embodiment, the propeller 60 is a foldable propeller that automatically transitions between a folded-together, collapsed configuration and a radially outwardly extending operative configuration in response to the motor 50 being turned on, and vice versa. For example, each of U.S. Pat. Nos. 4,204,806 and 5,183,384 is incorporated herein by reference, in its entirety. Alternatively, the propeller 60 may be replaced with a non-folding propeller or an impeller which may be part of a pump jet or water jet that creates a jet of water for propulsion, and the propulsion system may include a movable nozzle for directing the jet of water for steering purposes.

The AUV 20 may include any suitable type of control surfaces, including one or more pitch control surfaces in the form of one or more conventional hydrodynamic wings (not shown) that are for causing the AUV to move forward while alternately descending and ascending in the water 32 due to operation of the buoyancy engine 24. However and in accordance with the first embodiment, hydrodynamic wings are not included in the AUV 20. Rather, the AUV includes the right and left side fins 40 that operate at least as pitch control surfaces. In addition, the AUV 20 typically includes at least one other control surface in the form of an upright fin 64 that operates at least as a yaw control surface. The fins 40, 64 are movable control surfaces for steering or otherwise orienting the AUV in the body water 32.

Referring to FIG. 4, the movable fins 40, 64 project laterally, outwardly from the hull 22, and they are moved by respective internal components of the AUV 20 that are typically in the form of direct-current electric actuators 66. The hull 22 is partially cut away in FIG. 4 to schematically show the drive shaft 68 by which one of the actuators 66 is connected to, and rotates, the respective side fin 40. Regarding the representative drive shaft 68 shown in FIG. 4, it extends through an opening in the hull 22 and can be rotated back and forth in response to operation of the respective actuator 66. The respective fin 40 is fixedly mounted to the drive shaft 68 for rotating therewith. Each of the fins 40, 64 is similarly driven, by way of a drive shaft or any other suitable mechanism, by the respective actuator 66. The fins 40, 64 may be replaced with different types of fin assemblies, such as, but not limited to, fin assemblies with rudders (e.g., trailing edge rudders or pedestal rudders).

More specifically regarding the controller 28 schematically shown in FIG. 1, features of the controller may be embodied in any suitable manner, such as in software, firmware and/or hardware modules. For example, the controller 28 may be in the form of one or more computers (which may include appropriate input and output devices, a processor, memory, software modules, etc.) or any other suitable device(s) for controlling operations of the AUV 20 by virtue of receiving data from and providing data (e.g., instructions from the execution of software modules stored in memory) to respective components of the AUV. In this regard, the controller 28 may include or be associated with any suitable types of features or modules (e.g., software modules, such as an autopilot module for piloting the AUV 20, a switching module for switching between the various modes of operation of the AUV, and communication module(s) for facilitating communications between the AUV and other device(s)) for aiding in operation of the AUV. The types of modules included may depend upon the mission(s) of the AUV 20. For example, the controller 28 may include, or be operatively associated with, any modules that are conventionally included in AUVs, and the AUV 20 may include any types operational components (e.g., hardware in the form of sensing devices, transmitters, receives, etc.) that are conventionally included in AUVs. Some of the modules and/or features of the controller 28 are schematically illustrated in FIG. 1 by way of the controller being schematically shown as including compartments.

FIG. 1 is schematic, for example, because the AUV 20 includes numerous operational components 70*a*, 70*b*, 70*c* . . . 70*n* ("operational components 70*a-n*") that are schematically shown by dashed lines as being contained within one or more chambers that are hidden from view within the hull 22. The operational components 70*a-n* are, for example, for providing functionality that helps to facilitate the operation of or usefulness of the AUV 20. The operational components 70*a-n* may include an electrical power supply (e.g., a battery or batteries, which may be associated with one or more capacitors for providing relatively large pulses of current when desired); sonar; depth sensor; magnetometer; communication transceiver; autopilot system(s) or subsystem(s) (which may include a gyroscope) for controlling operations of the steering and propulsion systems of the AUV 20; and/or any other devices that may be useful, such as for carrying out operations described in this disclosure. As will be discussed in greater detail below, one or more of the operational components 70*a-n* is for detecting predetermined condition(s) and the controller 28 is for providing signals that cause the AUV 20 to automatically switch between modes of operation (e.g., the buoyancy, rotary propulsion and surface modes of operation) in response to the detecting of the predetermined condition(s).

For example, the forward-most operational component 70*a* may be a battery or pack of batteries for providing power. In an alternative embodiment of this disclosure, the forward-most operational component 70*a* is a movable mass that is mounted so that it may be moved forward and rearward in the AUV, such as through the action of a motor and/or any suitable gearing (not shown), for pitching the nose of the AUV 20 up and down in a manner that is cooperative with the changes in buoyancy for propelling the AUV. In contrast and in accordance with the first embodiment, the forward-most operational component 70*a* (e.g., a battery or pack of batteries) is stationary (e.g., it is not mounted for being moved forward and rearward in the AUV and, thereby, is typically not used as a movable mass for pitching the nose of the AUV 20 up and down). That is, solely or substantially solely the side fins 40 are used for pitch control. Other means (e.g., conventional means) for controlling the pitch of the AUV 20 may alternatively be used.

Figure 7:
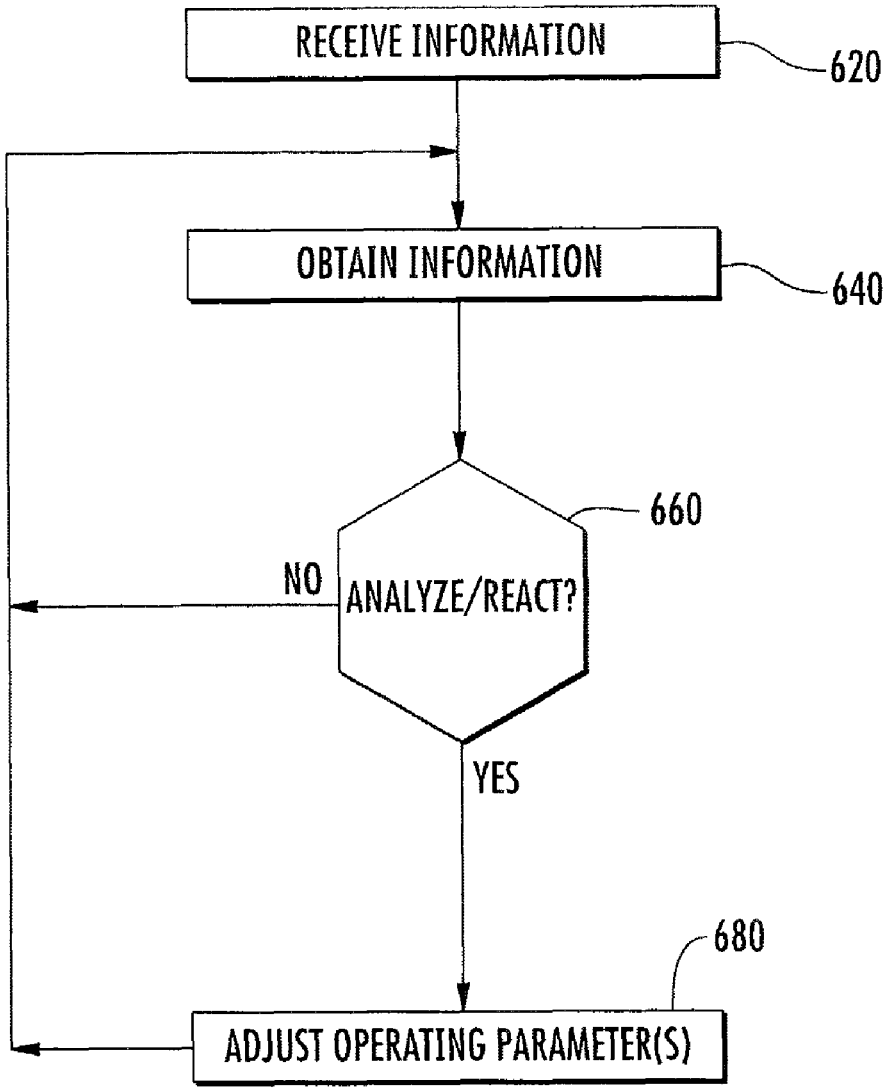
FIG. 7 is a flow diagram that provides a high-level illustration of how a controller of the AUV of FIG. 1 may control the operation of the AUV, in accordance with one example of the first embodiment.

Examples of methods of operating the AUV 20 are described in the following, in accordance with the first embodiment of this disclosure. The AUV 20 may be launched into the water 32 in any suitable manner. FIG. 7 is a flow diagram that provides a high level illustration of how the controller 28 (FIG. 1) may control the operation of the AUV within the body of water 32, in accordance with one example of the first embodiment. At block 620 of FIG. 7, the controller 28 receives, such as by way of one or more of the operational components 70*a-n* (FIG. 1), high-level information about the mission for the AUV 20 (e.g., information about the destination D (FIG. 5), what is to be done at the destination, and any associated timeframe). This information may be received at any suitable time, such as before launching the AUV 20 or after the AUV has been launched (e.g., while the AUV is at the surface of the body of water and communicating by way of an antenna (not shown) that extends above the surface). For example, the high-level information about the mission for the AUV 20 may have originated from a human user, or the like, and these instructions may be received by the AUV by way of a computer interface, radio frequency signals, antennas and/or any other suitable methods of communicating with the controller 28. The high-level information received by the controller 28 about the mission for the AUV 20 may include any suitable information about desired parameters and/or instructions that dictate how the controller is to control operation of the AUV. Notwithstanding the receipt of high-level instructions at block 620, typically the controller 28 is allowed to operate at least partially, substantially and/or totally autonomously to carry out the instructions received at block 620.

After receiving the high-level information about the mission at block 620, the controller 28 may operate autonomously/automatically (e.g., without receiving additional instructions from any human) through blocks 640-680 of the exemplary method schematically illustrated by FIG. 7. At block 640, the controller 28 obtains information, such as from one or more of the operational components 70*a-n*. For example, one or more of the operational components 70*a-n* may be for detecting information relevant to predetermined condition(s), and the controller 28 obtains or otherwise receives that information at block 640. For example, the information obtained at block 640 may be indicative of external environmental conditions around the AUV 20 and/or indicative of the AUV monitoring itself. For example, the information obtained by the controller 28 at block 640 may be indicative of how much energy is contained in the AUV's power supply.

At block 660 of FIG. 7, the information obtained at block 640 is analyzed by the controller 28 to determine whether any reaction may be necessary or helpful, such as for carrying out the instructions received at block 620. If it is determined by the controller 28 at block 660 that no reaction is necessary or desired, then control is transferred back to block 640. If it is determined by the controller 28 at block 660 that a reaction is necessary or desired, then control is transferred to block 680 of FIG. 7.

At bock 680, the controller 28 provides signals for adjusting one or more of the operating parameters of the AUV 20, and thereafter control is returned to block 640. For example, block 680 schematically illustrates that the controller 28 is operative for providing controlling signals to the buoyancy engine 24, rotary propulsion system 26 and steering system 27 that cause the AUV 20 to automatically switch between modes of operation (e.g., the buoyancy, rotary propulsion and surface modes of operation) and at least generally steer the AUV (e.g., toward the destination D) in response to the detecting of the predetermined condition(s). That is, blocks 640-680 schematically illustrate an example of a method by which one or more of the operational components 70*a-n* detects predetermined condition(s), and the controller 28 provides signals that cause the AUV 20 to automatically switch between modes of operation (e.g., the buoyancy, rotary propulsion and surface modes of operation) and steer the AUV in response to the detecting of the predetermined condition(s).

Blocks 640-660 of FIG. 7 schematically illustrates that, while the AUV 20 is in the water 32, the controller 28 may continually or periodically acquire data from respective operational components 70*a-n* (FIG. 1) and analyze the data in view of mission-related information obtained at block 620, to determine the mode of operation in which the AUV should be operating and the direction in which the AUV should be steered. Block 680 schematically illustrates that, in response to decisions made by the controller at block 660, the controller 28 provides signals for operating the AUV 20 (e.g., the controller provides signals to the buoyancy engine 24, rotary propulsion system 26 and/or the 27 steering system for controlling the operating of these features). The operations associated with blocks 640-680 may occur substantially simultaneously and continuously until the mission of the AUV 20 is completed or otherwise terminated. A few examples of methods resulting from operations associated with the controller 28/blocks 640-680 are described in the following, in accordance with the first embodiment of this disclosure.

As best understood with reference to FIGS. 7 and 5, an initial occurrence of the operations associated with blocks 640-680 may cause the AUV 20 to operate in the glider mode along section 38*a* of the path 30. Thereafter, an occurrence of the operations associated with blocks 640-680 may cause the AUV 20 to operate in the rotary propulsion mode along section 38*b* of the path 30. Thereafter, an occurrence of the operations associated with blocks 640-680 may cause the AUV 20 to operate in the glider mode along section 38*c* of the path 30. Thereafter, an occurrence of the operations associated with blocks 640-680 may cause the AUV 20 to operate in the surface mode at section 38*d* of the path 30. Thereafter, an occurrence of the operations associated with blocks 640-680 may cause the AUV 20 to operate in the glider mode along section 38*e* of the path 30. Thereafter, an occurrence of the operations associated with blocks 640-680 may cause the AUV 20 to operate in the rotary propulsion mode along section 384 of the path 30. Thereafter, an occurrence of the operations associated with blocks 640-680 may cause the AUV 20 to cease propelling itself when the AUV reaches the destination D. Thereafter or simultaneously, an occurrence of the operations associated with blocks 640-680 may cause the AUV 20 perform any suitable operation (e.g., any one or more operations that are conventionally performed by AUVs) while the AUV is at the destination D.

During the rotary propulsion mode, the motor 58 is operated to rotate the propeller 60 to provide thrust, and thereby cause the AUV 20 to move forward in the water 32. During the glider mode, the buoyancy engine 24 operated so that the ballast chamber 41 alternately ingests and expels water 32 to change the mass of the AUV 20 and thereby cause the AUV to alternately descend and ascend in the water, and the side fins 40 are pivoted to change the pitch of the AUV, so that the AUV moves forward while alternately descending and ascending in the water.

Reiterating from above and in accordance with one example of processes that occur by way of blocks 640-680 of FIG. 7 while the AUV 20 is, operating, the controller 28 is operative in conjunction with one or more of the operational components 70*a-n* to detect a predetermined condition, and then provide a signal for causing switching between the buoyancy and rotary propulsion modes of operation in response to the detecting of the predetermined condition. In accordance with the present example, the switching comprises changing from one of the buoyancy and rotary propulsion modes of operation to the other of the buoyancy and rotary propulsion modes of operation.

In a more specific example of a method of operating that may result from passing through blocks 640-680 of FIG. 7, the controller 28 provides signals for switching from the glider mode to the rotary propulsion mode in response to the controller 28 operating in conjunction with one or more of the operational components 70*a-n* to determine that the forward speed of the AUV 20 is below a predetermined value, the depth of the body of water 32 is below a predetermined value, and/or risk of a collision between the AUV and an object (e.g., a fishing trawler) exceeds a predetermined threshold. One of ordinary skill in the art will understand that it is conventional/not novel per se for a water vehicle to include operational components for determining the forward speed of the water vehicle, the depth of a body of water, and whether the risk of a collision between the water vehicle and another object exceeds a threshold. For example, conventional collision avoidance systems may work in conjunction with a water vehicle's radar or sonar system. More specifically, active systems using sonar are known for estimating the distance or range to an object or to a point on an object. Such systems may also be used to estimate velocity by differentiating the range, or by using the Doppler effect. The ratio of distance to velocity may then be used to estimate the time to contact. Examples of sonar-based collision avoidance systems are disclosed in U.S. Patent Application Publication Nos. 2009/0292468, 2009/0259401, 2009/0259400 and 2008/0024356, each of which is incorporated herein by reference, in its entirety.

In another specific example of a method of operating that may result from passing through blocks 640-680 of FIG. 7, the controller 28 provides signals for switching from the rotary propulsion mode to the glider mode in response to the controller operating in conjunction with one or more of the operational components 70*a-n* to determine that any current that flows against the forward movement of the AUV 20 (e.g., a head-current that flows against the forward direction of travel of the AUV) is below a predetermined value, the time until arrival at the destination D is below a predetermined value, and/or the power (e.g., the remaining charge on the batteries 70*a*) available for operating the rotary propulsion system 26 is below a predetermined value.

In another example of a method of operating that may result from passing through blocks 640-680 of FIG. 7, the controller 28 provides signals for switching from any one of the rotary propulsion mode and the glider mode to the surface mode. In this particular example, the switching may occur in response to the controller 28 operating in conjunction with one or more of the operational components 70*a-n* to determine that the power (e.g., the remaining charge on the batteries 70*a*) available is below a predetermined value or that at predetermined period of time has lapsed since the AUV 20 was last in the surface mode, such as for receiving instructions or other information at block 620 of FIG. 7. For example, any time the AUV 20 is in the surface mode, an antenna (not shown) of the AUV may extend, or may be extended, above the surface of the body of water 32 for the purpose of communicating with other device(s) such as, but not limited to, navigations systems (e.g., space-based global navigation satellite systems such as the Global Positioning System (GPS)) other water vessels or land-based navigation or communication systems, or the like. It is conventional/not novel per se for an antenna (not shown) of an AUV to extend above the surface of a body of water while the AUV is proximate the surface of the body of water.

During both the buoyancy and the rotary propulsion modes, the actuators 66 (FIG. 4) may be operated to move the fins 40, 64 in a manner that steers the AUV 20 through the water 32 toward the destination D or toward other locations, such as in response to signals that are provided by the controller 28 (e.g., the autopilot module of or associated with the controller) at block 680 of FIG. 7. More specifically, during both the buoyancy and the rotary propulsion modes the top fin 64 may be pivoted in either direction relative to the hull 22 of the AUV 20 to steer the AUV right or left, respectively. Also during both the buoyancy and the rotary propulsion modes (e.g., throughout both the buoyancy and the rotary propulsion modes), the side fins 40 may be pivoted in either direction relative to the hull 22 of the AUV 20 to adjust the pitch of the AUV. More specifically and for example, the operating of the AUV 20 in the glider mode includes pivoting the side fins 40 (e.g., pitch control surfaces) of the AUV relative to the hull 22 of the AUV and, thereby, adjusting the pitch of the AUV while the AUV is moving forward in the body of water 32. For example, the controller 28 may be operative by way of a method comprising blocks 640-680 of FIG. 7 for providing signals at block 680 that result in pivoting of the side fins 40 in either direction relative to the hull 22 to adjust the pitch of the AUV during any portion of (e.g., during the entirety of) both an ascending portion of the buoyancy mode and a descending portion of the buoyancy mode to control the trajectory of the AUV in a manner that optimizes its performance (e.g., in a manner that increases speed and/or reduces energy consumption).

Figure 8:
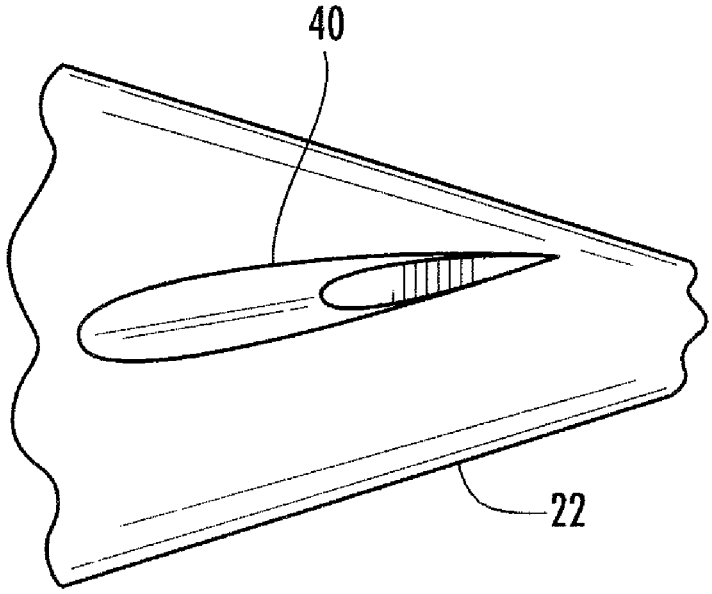
FIGS. 8 and 9 generally are end elevation views of a representative side fine of the AUV of FIG. 1, with a portion of the underlying hull structure of the AUV also being shown, wherein these figures respectively show the side fin in inclined and declined configurations.
Figure 9:
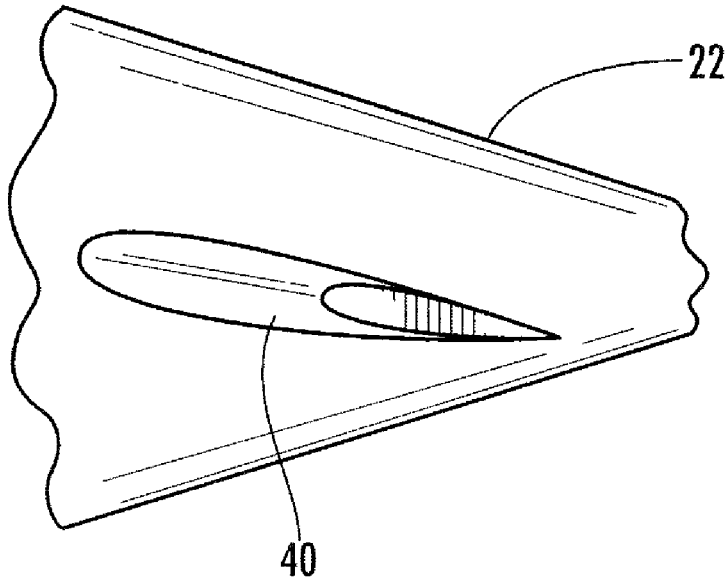

In this regard, each of the side fins 40 may be pivoted between numerous positions including inclined and declined configurations that are respectively schematically shown in FIGS. 8 and 9 for a representative one of the side fins. In the inclined configuration, the top surface of each of the side fins 40 is more forward-facing than the bottom surface of the side fin. In the declined configuration the bottom surface of each of the side fins 40 is more forward-facing than the top surface of the side fin. The side fins 40 may be in the inclined configuration (e.g., see FIG. 8) during both: the glider mode while the AUV 20 is descending and moving forward; and the rotary propulsion mode while the AUV is ascending and moving forward. The side fins 40 may be in the declined configuration (e.g., see FIG. 9) during both the glider mode while the AUV 20 is ascending and moving forward; and the rotary propulsion mode while the AUV is descending and moving forward. That is and in accordance with a method of operating that may result from repeatedly passing through blocks 640-680 of FIG. 7, the trim angle of the AUV 20 may be continually adjusted in real-time by adjusting the positions of the side fins 40 in response to detected operating conditions such as depth of the AUV, speed of the AUV, depth of the body of water 32 and/or salinity (density) of the water 32. In this manner, the endurance of the AUV 20 may be optimized, since endurance is a function of the trim angle of the AUV and the life of the battery 70*a*. That is and in accordance with a method of operating that may result from repeatedly passing through blocks 640-680 of FIG. 7, endurance may be increased by reducing power consumption. As another example, and in accordance with a method of operating that may result from repeatedly passing through blocks 640-680 of FIG. 7, the trim angle of the AUV 20 may be continually adjusted in real-time by adjusting the positions of the side fins 40, in order to optimize the speed of the AUV 20 in the glider mode and/or the rotary propulsion mode.

One of ordinary skill will understand that a change in salinity (i.e., a change in the amount of salt present in the water 32 and a change in the water's density) may occur during the course of a mission (e.g., when traveling from the ocean into a river). The amount of salinity impacts the buoyancy of the AUV 20 and its trim. In another example of a method of operating that may result from repeatedly passing through blocks 640-680 of FIG. 7, the controller 28 may be operative for optimizing the buoyancy of the AUV 20 and its trim in response to water salinity in real-time.

The controller 28 typically includes or is otherwise associated with one or more computer-readable mediums (e.g., nonvolatile memory and/or volatile memory such as, but not limited to, flash memory, tapes and hard disks such as floppy disks and compact disks, or any other suitable storage devices) having computer-executable instructions (e.g., one or more software modules or the like), with computer(s) handling (e.g., processing) the data in the manner indicated by the computer-executable instructions. Accordingly, aspects of FIGS. 1, 5 and 7 can be characterized as respectively being schematically illustrative of the computer-readable mediums, computer-executable instructions and other features of methods and systems of the exemplary embodiments of this disclosure.

The internal components of the AUV 20 may be mounted in any suitable manner. For example, they may be mounted to (e.g., within) the body (e.g., hull 22) of the AUV 20, such as by way of any suitable internal supports (e.g., bulkheads, mounting brackets, struts, or the like, that are not shown in the figures). One or more of the components that are typically internal to the AUV 20 may, alternatively, be external components, which may be mounted to the exterior of the hull 22 or in any other suitable manner.

Whereas the AUV 20 of has been described as including one of each of the buoyancy engine 24 and the rotary propulsion system 26, the AUV may include two or more buoyancy engines, two or more rotary propulsion systems and/or two or more of any of the components of the buoyancy engine and/or the rotary propulsion system if desired (e.g., for purposes of redundancy). Similarly, whereas some specific types and arrangements of propulsion systems (e.g., the buoyancy engine 24 and the rotary propulsion system 26) are described herein, any suitable arrangements and/or types of propulsion systems may be used in the AUV 20.

Figure 10:
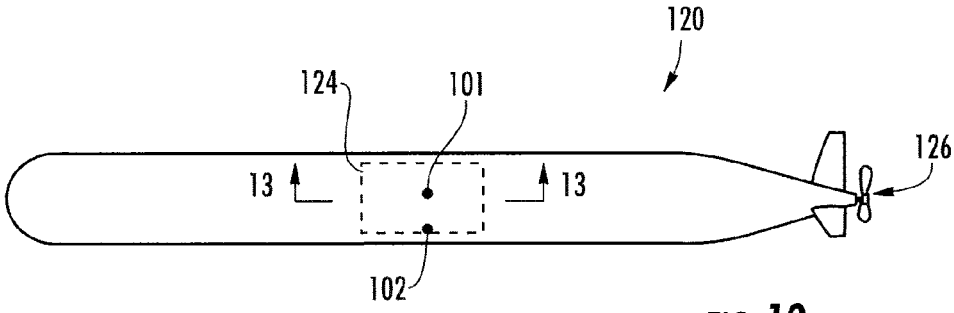
FIGS. 10-12 are schematic side elevation views of an AUV in accordance with a second embodiment of this disclosure, and these figures show that the location of the center of mass of the AUV remains the same (e.g., substantially the same) at different pitch angles.
Figure 11:
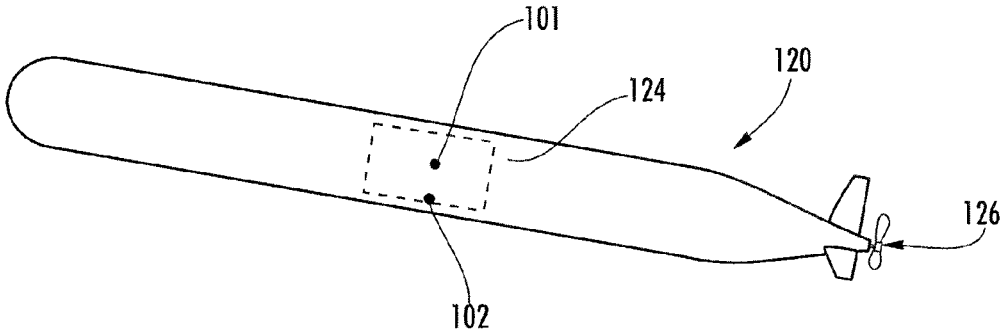
Figure 12:
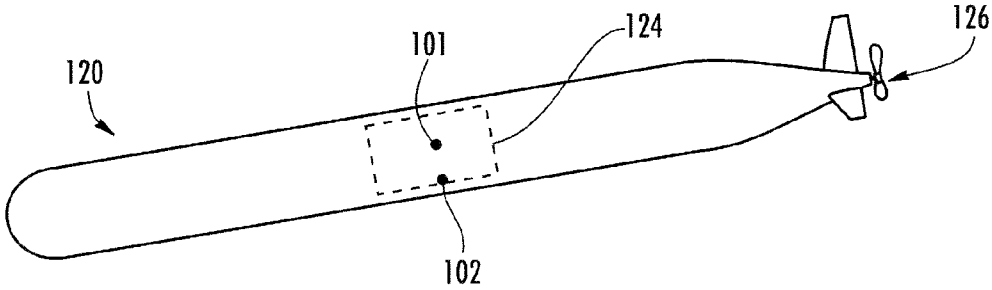

The second embodiment of this disclosure is like the first embodiment, except for variations noted and variations that will be apparent to one of ordinary skill in the art; therefore, reference numerals for at least somewhat alike features are incremented by one hundred. FIGS. 10-12 are each schematic side elevation views of an AUV 120 that is described in the following, in accordance with the second embodiment. In FIGS. 10-12, the AUV's internal buoyancy engine 124 (e.g., ballast system) is shown in dashed lines, and the center of buoyancy 101 and the center of mass 102 are also schematically shown. FIG. 13 is a schematic cross-sectional view of a middle portion of (e.g., the buoyancy engine 124 of) the AUV 120, with the cross-section taken substantially along lines 13-13 of FIG. 10.

As best understood with reference to FIG. 13, the buoyancy engine's cylinder 142 has opposite ends that are fully closed, and there are two pistons 143*a*, 143*b* within the cylinder. A single liquid chamber 145 is between the pistons 143*a*, 143*b*, within the cylinder 142. Within the cylinder 142, gas chambers 144*a*, 144*b* are respectively between the opposite ends of the cylinder and the pistons 143*a*, 143*b*. Each of the gas chambers 144*a*, 144*b* is fully closed. Although the pressure within the gas chambers 144*a*, 144*b* changes in response to movement of the pistons 143*a*, 143*b*, the pistons move substantially symmetrically with respect to one another so that the pressure within the gas chamber 144*a* is substantially always substantially equal to the pressure within the gas chamber 144*b*.

A single bladder 147 encircles the cylinder 142 and is within the ballast chamber 141 defined between the exterior of the cylinder 142 and the interior of the hull 122, although there could be more than one bladder and/or the bladder may be differently configured. Each of the liquid chamber 145 and the bladder 147 is closed, except for being open to one another by way of a passageway 146 (e.g., tube(s), pipe(s) or any other suitable means for fluid communication) having opposite ends that are respectively open to the bladder 147 and the liquid chamber 145.

The pistons 143*a*, 143*b* may be synchronously reciprocated by any suitable devices such as, but not limited to, a hydraulic system for changing the volume of the liquid chamber 145. The hydraulic system operates so that the pistons 143*a*, 143*b* move in response to changes in pressure between the liquid chamber 145 and the gas chambers 144*a*, 144*b*. More specifically, the hydraulic system is schematically shown in FIG. 13 as including a motor-driven pump 103 that is positioned between two parts of the passageway 146. The motor of the motor-driven pump 103 may be a direct current, electric motor, and the motor may include or otherwise be linked to gears for stepping up or stepping down the motor's output.

The motor-driven pump 103 is operated in a first direction to pump liquid (e.g., oil) from the liquid chamber 145 to the bladder 147, so that the pistons 143*a*, 143*b* move toward one another, and the bladder 147 expands to expel water 32 from the ballast chamber 141, so that the AUV 120 may ascend. The motor-driven pump 103 is operated in an opposite, second direction (or otherwise valves (not shown) are operated to redirect the flow) to pump the liquid (e.g., oil) from the bladder 147 to the liquid chamber 145, so that the pistons 143*a*, 143*b* move away from one another, and the bladder 147 contracts so that water 32 is drawn into the ballast chamber 141, so that the AUV 120 may descend. One or more position sensors (not shown) may be respectively associated with the pistons 143*a*, 143*b*, for providing feedback that is used in controlling the motor-driven pump 103 (e.g., to turn the pump 103 off in response to the pistons having travelled to a predetermined position). The sensors may be respectively embedded in the pistons 143*a*, 143*b* for providing feedback for piston position within the cylinder 142, for providing precision control over operation of the buoyancy engine 124.

In accordance with the second embodiment, the pistons 143*a*, 143*b* are positioned and move concertedly so that the position of the center of mass 102 of the AUV 120 does not change (e.g., substantially does not change) with respect to the center of buoyancy 101 throughout all of the modes of operation of the second AUV. More specifically, the center of mass 102 and the center of buoyancy 101 of the AUV 120 may be at the same longitudinal position (e.g., substantially the same longitudinal position) along the length of the AUV 120 throughout all of the modes of operation of the AUV. For example, in FIG. 10 the AUV 120 has a pitch angle of about zero degrees, in FIG. 11 the AUV has a pitch angle of about positive ten degrees, and in FIG. 12 the AUV has a pitch angle of about negative ten degrees, and the location of the center of mass 102 remains substantially unchanged throughout FIGS. 10-12 (e.g., there is substantially no shift in the center of mass). The dual-piston buoyancy engine 124 may be characterized as being a self-contained, single unit, symmetrical-hydro-pneumatic buoyancy engine that provides the AUV 120 with a stable-fixed-point center of gravity (e.g., a stable center of gravity—zero shift in the center of gravity).

In accordance with the second embodiment, the AUV 120 has a stable center of gravity during changes in buoyancy and water salinity, due to the travel of the pistons 143*a*, 143*b* being symmetric as the volume of the liquid chamber 145 is either increased or decreased. The travel of the pistons 143*a*, 143*b* is symmetric because the air compression in the gas chambers 144*a*, 144*b* is uniform and equal. The oil in the hydraulic system (i.e., the oil in the liquid chamber 145, bladder 147, passageway 146 and pump 103) may have a specific gravity of 0.92, which is very close to the specific gravity of saltwater, which is 1.025. When the oil is pumped from the bladder 147 to the liquid chamber 145 the reduced volume of the bladder is replaced by seawater in the ballast chamber 141. As a result, the system is balanced as any ballast weight is changed symmetrically fore and aft from the center of the cylinder 142.

Also, by changing the net buoyancy of the AUV 120 with the buoyancy engine 124 and adjusting the side fins 140 accordingly, the AUV may rise and dive symmetrically (i.e., while remaining horizontal) at a zero horizontal speed, without operating the rotary propulsion system. This seeks to avoid (e.g., preclude) surface capture. Surface capture is a condition in which an underwater glider develops enough speed for its rear fins to pitch the nose down, and the positive buoyancy lifts the vehicle's aft end with the fins and propeller above the surface of the water so that propeller propulsion and fin control are lost. Stated differently, surface capture is the loss of propulsion and fin control due to vehicle buoyancy lifting the aft section of the vehicle into the air when the vehicle attempts to dive off (i.e., below) the water surface.

The third embodiment of this disclosure is like the second embodiment, except for variations noted and variations that will be apparent to one of ordinary skill in the art. The rotary propulsion system 126 is omitted from the AUV of the third embodiment.

It will be understood by those skilled in the art that while the present disclosure has been discussed above with reference to exemplary embodiments, various additions, modifications and changes can be made thereto without departing from the spirit and scope of the invention as set forth in the claims.

What is claimed is:

1. An autonomous unmanned underwater vehicle ("AUV") for traveling in a body of water, the AUV comprising:

a body comprising a hull;

a buoyancy engine carried by the body, wherein the AUV has mass, and the buoyancy engine is for alternately ingesting and expelling the water to change the mass of the AUV and thereby cause the AUV to alternately descend and ascend in the water, and wherein the buoyancy engine comprises a reciprocating piston;

at least one pitch control surface carried by the body for causing the AUV to move forward while alternately descending and ascending in the water;

a rotary propulsion system carried by the body and including an electric motor for rotating a rotary agitator in the water to provide thrust, and thereby cause the AUV to move in the water, wherein the rotary agitator includes at least one of a propeller and an impeller; and a controller operative for responsively, automatically switching between at least a glider mode in which the buoyancy engine and the at least one pitch control surface are cooperative for causing the AUV to move forward while alternately descending and ascending, and a rotary propulsion mode in which the rotary propulsion system is operative for causing the AUV to move forward.

2. The AUV of claim 1, wherein:

the rotary propulsion system is not operative during the glider mode; and the buoyancy engine is not operative during the rotary propulsion mode.

3. The AUV of claim 1, comprising an actuator, wherein:

the at least one pitch control surface comprises a fin that projects laterally, outwardly from the hull, is pivotable relative to the body of the AUV for adjusting pitch of the AUV, and has opposite top and bottom surfaces;

the actuator is operatively connected to the fin for pivoting the fin and thereby adjusting pitch of the AUV; and the controller is operative for controlling the actuator to pivot the fin between a plurality of positions including an inclined configuration in which the top surface of the fin is more forward-facing than the bottom surface of the fin, and a declined configuration in which the bottom surface of the fin is more forward-facing than the top surface of the fin.

4. The AUV of claim 3, wherein the controller is operative so that:

the fin is in the inclined configuration during both the glider mode while the AUV is descending and moving forward, and the rotary propulsion mode while the AUV is ascending and moving forward; and the fin is in the declined configuration during both the glider mode while the AUV is ascending and moving forward, and the rotary propulsion mode while the AUV is descending and moving forward.

5. The AUV of claim 1, wherein:

the AUV has a center of buoyancy when submerged in water;

the hull defines a centroid that is the center of buoyancy of the AUV when the AUV is submerged in the water;

the AUV has a mass and a center of mass; and the buoyancy engine is operative to move the center of mass of the AUV relative to the center of buoyancy of the AUV.

6. The AUV of claim 5, wherein the buoyancy engine is operative to move the center of mass of the AUV:

forward of the center of buoyancy of the AUV during the descending of the AUV; and rearward of the center of buoyancy of the AUV during the ascending of the AUV.

7. The AUV of claim 1, wherein the rotary agitator includes the propeller, and the propeller extends from a rear end of the hull.

8. A method of operating an autonomous unmanned underwater vehicle ("AUV") in a body of water, comprising:

operating the AUV in a glider mode, comprising operating a buoyancy engine of the AUV to cause the AUV to move forward in the body of water while alternately descending and ascending in the body of water;

operating the AUV in rotary propulsion mode, comprising operating a rotary propulsion system of the AUV to cause the AUV to move forward in the body of water;

detecting a predetermined condition, wherein the predetermined condition comprises at least one condition selected from the group consisting of forward speed of the AUV being below a predetermined value, depth of the body of water being below a predetermined value, and risk of a collision between the AUV and an object exceeding a threshold; and switching from the glider mode to the rotary propulsion mode in response to the detecting of the predetermined condition, wherein the switching comprises changing from the glider mode to the rotary propulsion mode.

9. The method of claim 8, wherein the operating the AUV in the glider mode further comprising pivoting a pitch control surface of the AUV relative to a hull of the AUV during the glider mode and, thereby, adjusting pitch of the AUV while the AUV is moving forward in the body of water.

10. The method of claim 8, wherein the predetermined condition is a first predetermined condition, and the method comprises:

detecting a second predetermined condition; and switching from the rotary propulsion mode to the glider mode in response to the detecting of the second predetermined condition.

11. The method of claim 10, wherein the second predetermined condition comprises at least one condition selected from the group consisting of:

any current that flows against the forward movement of the AUV being below a predetermined value;

a time until arrival at a destination being below a predetermined value; and power available for operating the rotary propulsion system being below a predetermined value.

12. The method of claim 8, wherein:

the operating of the buoyancy engine comprises alternately ingesting water from the body of water into the AUV and expelling water from the AUV to the body of water to change mass of the AUV and, thereby, cause the AUV to alternately descend and ascend in the body of water; and the operating of the rotary propulsion system comprises rotating a rotary agitator in the water to provide thrust and, thereby, cause the AUV to move forward in the body of water.

13. The method of claim 8, further comprising operating the AUV in a surface mode, comprising expelling water from the AUV to the body of water to decrease mass of the AUV and, thereby, cause the AUV ascend to a surface of the body of water.

14. An autonomous unmanned underwater vehicle ("AUV") for traveling in a body of water, the AUV comprising:

a body comprising a hull;

a buoyancy engine carried by the body, wherein the AUV has mass, and the buoyancy engine is for alternately ingesting and expelling the water to change the mass of the AUV and thereby cause the AUV to alternately descend and ascend in the water;

at least one pitch control surface carried by the body for causing the AUV to move forward while alternately descending and ascending in the water, wherein the at least one pitch control surface comprises a fin that projects laterally, outwardly from the hull, is pivotable relative to the body of the AUV for adjusting pitch of the AUV, and has opposite top and bottom surfaces;

an actuator operatively connected to the fin for pivoting the fin and thereby adjusting pitch of the AUV;

a rotary propulsion system carried by the body and including a motor for rotating a rotary agitator in the water to provide thrust, and thereby cause the AUV to move in the water, wherein the rotary agitator includes at least one of a propeller and an impeller; and a controller operative for responsively, automatically switching between at least a glider mode in which the buoyancy engine and the at least one pitch control surface are cooperative for causing the AUV to move forward while alternately descending and ascending, and a rotary propulsion mode in which the rotary propulsion system is operative for causing the AUV to move forward, wherein the controller is operative for controlling the actuator to pivot the fin between a plurality of positions including an inclined configuration in which the top surface of the fin is more forward-facing than the bottom surface of the fin, and a declined configuration in which the bottom surface of the fin is more forward-facing than the top surface of the fin.

15. The AUV of claim 14, wherein the controller is operative so that:

the fin is in the inclined configuration during both the glider mode while the AUV is descending and moving forward, and the rotary propulsion mode while the AUV is ascending and moving forward; and the fin is in the declined configuration during both the glider mode while the AUV is ascending and moving forward, and the rotary propulsion mode while the AUV is descending and moving forward.

16. An autonomous unmanned underwater vehicle ("AUV") for traveling in a body of water, the AUV comprising:

a body comprising a hull, wherein the AUV has a center of buoyancy when submerged in water, and the hull defines a centroid that is the center of buoyancy of the AUV when the AUV is submerged in the water;

a buoyancy engine carried by the body, wherein the AUV has mass, and the buoyancy engine is for alternately ingesting and expelling the water to change the mass of the AUV and thereby cause the AUV to alternately descend and ascend in the water, and the AUV has a center of mass and the buoyancy engine is operative to move the center of mass of the AUV relative to the center of buoyancy of the AUV;

at least one pitch control surface carried by the body for causing the AUV to move forward while alternately descending and ascending in the water;

a rotary propulsion system carried by the body and including a motor for rotating a rotary agitator in the water to provide thrust, and thereby cause the AUV to move in the water, wherein the rotary agitator includes at least one of a propeller and an impeller; and a controller operative for responsively, automatically switching between at least a glider mode in which the buoyancy engine and the at least one pitch control surface are cooperative for causing the AUV to move forward while alternately descending and ascending, and a rotary propulsion mode in which the rotary propulsion system is operative for causing the AUV to move forward.

17. The AUV of claim 16, wherein the buoyancy engine is operative to move the center of mass of the AUV:

forward of the center of buoyancy of the AUV during the descending of the AUV; and rearward of the center of buoyancy of the AUV during the ascending of the AUV.

18. A method of operating an autonomous unmanned underwater vehicle ("AUV") in a body of water, comprising:

operating the AUV in a glider mode, comprising operating a buoyancy engine of the AUV to cause the AUV to move forward in the body of water while alternately descending and ascending in the body of water;

operating the AUV in rotary propulsion mode, comprising operating a rotary propulsion system of the AUV to cause the AUV to move forward in the body of water;

detecting a predetermined condition, wherein the predetermined condition comprises at least one condition selected from the group consisting of any current that flows against the forward movement of the AUV being below a predetermined value, a time until arrival at a destination being below a predetermined value, and power available for operating the rotary propulsion system being below a predetermined value; and switching from the rotary propulsion mode to the glider mode in response to the detecting of the predetermined condition, wherein the switching comprises changing from the rotary propulsion mode to the glider mode.

19. The method of claim 18, wherein the operating the AUV in the glider mode further comprising pivoting a pitch control surface of the AUV relative to a hull of the AUV during the glider mode and, thereby, adjusting pitch of the AUV while the AUV is moving forward in the body of water.

20. The method of claim 18, wherein:

the operating of the buoyancy engine comprises alternately ingesting water from the body of water into the AUV and expelling water from the AUV to the body of water to change mass of the AUV and, thereby, cause the AUV to alternately descend and ascend in the body of water; and the operating of the rotary propulsion system comprises rotating a rotary agitator in the water to provide thrust and, thereby, cause the AUV to move forward in the body of water.

* * * * *